US005899456A

United States Patent [19]

Weinstock et al.

[11] Patent Number: 5,899,456

[45] Date of Patent: May 4, 1999

[54] PROGRESSIVE TRIVIA GAME

[76] Inventors: Andrew D. Weinstock, 445 Betz Pl., Metarrie, La. 70005; Michael P. Trolman, 30 Lincoln Plz., 30 West 63rd St., Apt. 8A, New York, N.Y. 10023; Peter G. Weinstock, 6522 Pemberton Dr., Dallas, Tex. 75230

[21] Appl. No.: 09/005,446

[22] Filed: Jan. 12, 1998

[51] Int. Cl.[6] ..... A63F 3/00

[52] U.S. Cl. ..... 273/243; 273/248; 273/432

[58] Field of Search ..... 273/242, 243, 273/248, 249, 308, 430, 431, 432

[56] References Cited

U.S. PATENT DOCUMENTS

| | | | |
|---|---|---|---|
| 4,090,717 | 5/1978 | Rossetti | 273/249 |
| 4,449,710 | 5/1984 | Davis | 273/249 |
| 4,607,848 | 8/1986 | Maguire et al. | 273/269 |
| 4,807,878 | 2/1989 | Tripp . | |
| 4,998,735 | 3/1991 | Blackwell, III | 273/249 |
| 5,145,184 | 9/1992 | Yearick et al. | 273/248 |
| 5,193,818 | 3/1993 | Leeson | 273/308 X |
| 5,467,997 | 11/1995 | Bashirzadeh | 273/308 X |
| 5,609,339 | 3/1997 | Mahoney | 273/255 |
| 5,690,336 | 11/1997 | Oliver | 273/308 X |

*Primary Examiner*—William E. Stoll
*Attorney, Agent, or Firm*—Jenkins & Gilchrist

[57] ABSTRACT

A progressive trivia game for two or more participants having a playing board with a path made of a plurality of symbolic positions, a six sided die, a plurality of question and answer cards and a timer. A player rolls the die to move to a symbolic position. The symbolic position defines a category of trivia. The card provides elements of an answer. The player scores a greater number of points by providing an answer before (a) time runs out and (b) by providing the answer by knowing a lesser number of elements. The object of the game is to be the first to score a predetermined amount of points.

7 Claims, 3 Drawing Sheets

30

| 1 | 2 | 3 | 4 | 5 | 6 |
|---|---|---|---|---|---|
| NAME | NAME | NAME | NAME | NAME | NAME |
| | | | | | |

PROGRESSIVE TRIVIA GAME

BACKGROUND OF THE INVENTION

1. Technical Field of the Invention

The present invention relates to trivia games. More particularly, the present invention relates to trivia games that incorporate question cards.

2. Description of Related Art

Trivia games require a player to remember various tid-bits of information about a variety of subject matters. A player is asked a question. Upon answering the question correctly, the player may advance toward winning the game.

Trivia games have taken numerous forms in the past. Generally, a player or team is asked a question. The question must be answered in a specific amount of time. If the question is answered within time the player/team may move a game piece on a playing board toward a finish. The first player/team to advance to the finish wins the game.

One drawback of prior trivia games is that the question presented must be answered or the turn is lost. The entire question is provided and if the player/team does not answer the question correctly in the required time, then it is the next player/team's turn. No second chance or additional clues are provided when the question cannot be answered on a first try.

Another drawback of prior trivia games is that the dice, spinner or luck of the draw always determine which trivia category a player/team must respond to. Other participants in the game or the player/team are not able to choose which trivia category the question should come from.

Still another drawback of prior trivia games is that a player must advance to the designated finish on the playing board. Points are not provided for correct answers.

SUMMARY OF THE INVENTION

The mentioned drawbacks of prior trivia games and other drawbacks are intended to be overcome by the exemplary embodiments of the present invention in which there is provided a playing board with a continuous playing path having a plurality of spaces for a game piece to land on. Various trivia categories are symbolized on the plurality of spaces such that when a game piece lands on a playing space a trivia category question associated with the playing space is asked. Some of the playing spaces request other players/teams to vote and select what trivia category the question should come from. Still other playing spaces allow the player/team responsible for the game piece to be able to choose which trivia category the question should come from.

The exemplary trivia questions are organized to provide elements of an answer. For example: the names of various actors who starred in a movie. The player/team is provided some, but not all of the elements. If answered correctly, a score is provided to the player/team. If answered incorrectly, the remaining elements are provided to the player/team and the player/team may guess again. If answered correctly, a smaller score is provided to the player/team. The resulting exemplary game is interesting, entertaining, and fast paced.

BRIEF DESCRIPTION OF THE DRAWINGS

A more complete understanding of the method and apparatus of the present invention may be had by reference to the following Detailed Description when taken in conjunction with the accompanying Drawings wherein.

DETAILED DESCRIPTION OF A PRESENTLY PREFERRED EXEMPLARY EMBODIMENT

The present invention is a novel and useful trivia game and method for playing the trivia game that provides amusement and entertainment to the players. The game preferably tests the player's ability to match names of actors to a movie in which they had a role. A list of elements (actors) is provided and the player names an item (a movie) that the elements belong to.

Figure 1:
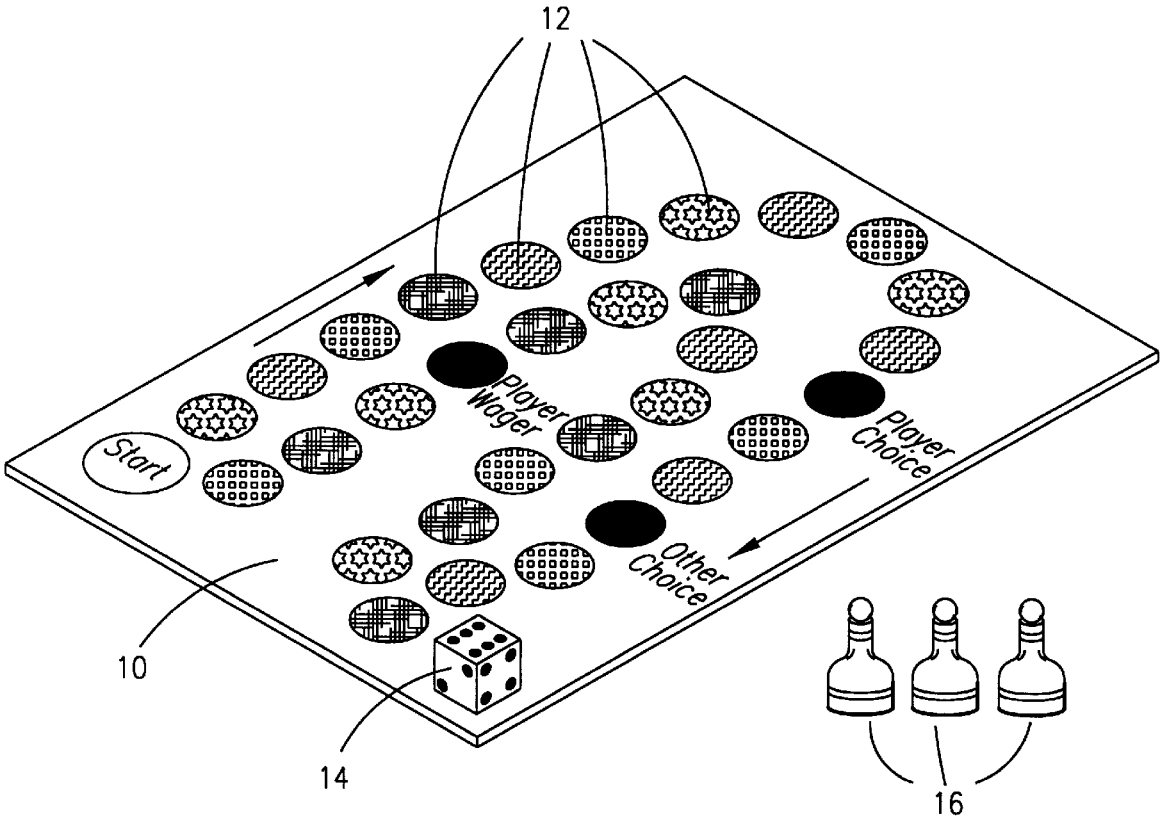
FIG. 1 depicts an exemplary playing board, game pieces and die.

In an exemplary embodiment of the present game, there is required a playing board, game pieces, a multi-sided die, at least 500 question and answer cards, and a timer. FIG. 1 depicts an exemplary playing board 10. In the exemplary game, there are four (4) categories of trivia questions. The game board preferably consists of a continuous path having 28 category spaces. The spaces are randomly divided into 4 different colors or symbols to represent the different trivia categories.

A die is used to indicate the number of spaces a participant is to move his game piece. The game pieces 16 start on the starting place and are moved the number of spaces corresponding to a roll of the die. The die 14 could be replaced by a spinner, a popper, an electronic number randomizer, etc. The die 14 may be a multi-sided object with various symbols or colors representing the next category that the player is to land on as well. Furthermore, the playing board 10 could take a variety of shapes, sizes, and designs. The playing board 10 can have any number of game trivia topics.

Figure 2:
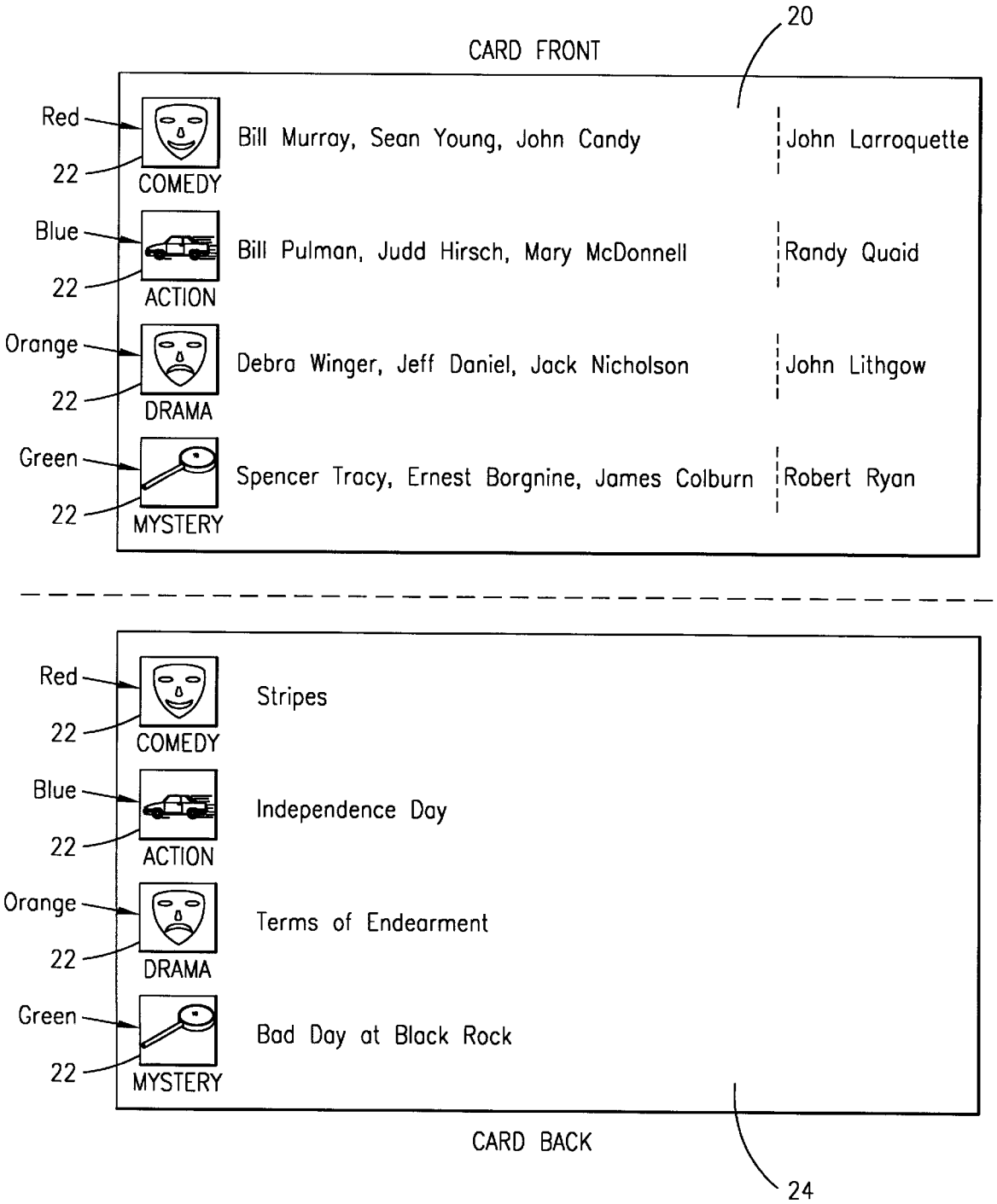
FIG. 2 depicts an exemplary card front and card back.

In FIG. 2, exemplary question cards are depicted. The front side of the card 20 depicts a symbol 22 for each category. Next to each symbol 22 is a listing of elements. The elements are related to or contained in the trivia answer. For example, if the trivia category is comedy movies, the listing of elements may be Bill Murry, Sean Young, John Larroquette, and John Candy. The trivia answer to these elements would be the comedy motion picture "Stripes."

The back of the card 24 depicts a symbol of each trivia category with the correct answer next to each symbol. In the preferred embodiment of the present game, there are 500 question cards thereby making the questions and answers difficult to memorize even after many hours of or repetitions of playing the game.

Figures 3, 4:
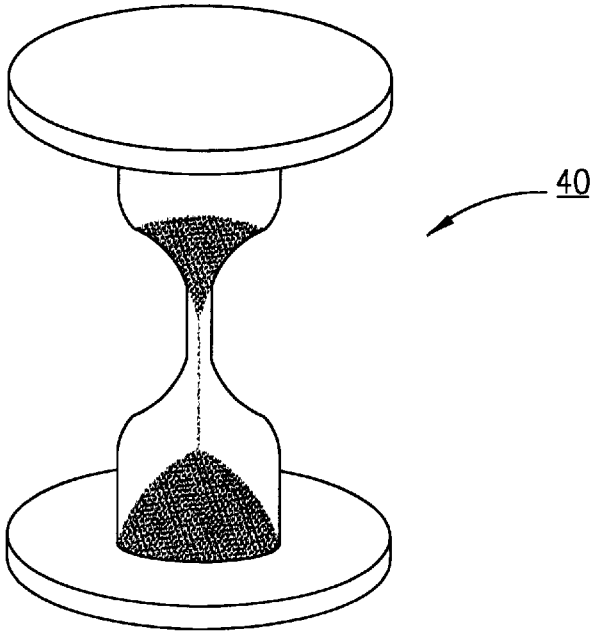
FIG. 3 depicts an exemplary score card.
FIG. 4 depicts an exemplary timer.

FIG. 3 depicts an exemplary score card 30 used in scoring the play of the exemplary game. The score card provides columns for each player (or team) name and rows for the points to be tallied in and totaled down the columns.

FIG. 4 depicts an exemplary sand timer 40 which measures 30 seconds of time. It is understood that any timer that measures a predetermined amount of time could be used in the present game. Such timers include, but are not limited to, wind-up timers, clock timers, count-down timers, electronic timers, etc.

Rules and method for playing the exemplary game are as follows: the game is played by two or more players or teams. Each player or team (hereinafter "player") places a game piece in the start location. Play proceeds clockwise around the board. It is decided which player is to go first. The die is rolled and the player moves his game piece a corresponding number of squares landing on a position that corresponds to a category. In the exemplary game the categories are related to actors or elements found in movies. The categories could be Action movies, Drama movies, Comedy movies, and Classic movies. These categories could be represented on the game board by symbols, colors, textures, etc. Examples of categories and colors could be Blue—Action, Orange—Drama, Red—Comedy, Green—Classics.

When the player lands on a category, a question card is drawn and the player must respond to a question in the appropriate corresponding category. When a question card is drawn the first three (3) elements (names) are provided to the player. In the exemplary game, three (3) names are of actors/actresses who appeared together in a movie under the category are provided to the player. The timer is started and the player has 30 seconds to name the movie. If the correct answer is given by the player within 30 seconds it is worth two (2) points.

At the end of the 30 seconds, if the correct answer has not been provided (one guess only), the fourth element (actor/actress) is read from the card. The player then is provided an additional 30 seconds to provide the correct answer (one guess). If the correct answer is provided within the 30 seconds, it is worth one (1) point. Regardless of whether the question was answered correctly or not, play then proceeds to the next player wherein the dice is rolled and the next player moves his game piece to a new playing space.

The playing board may contain spaces having markings stating "Players Choice", "Player Wager", and "Other Player Choice". If a player's game piece lands on a Player Choice space then the player may choose the trivia question category. If a player's game piece lands on a Player Wager space then the player may choose both the question category and the number of points (preferably up to six (6) in multiples of 2, to be wagered. The player is provided the first 3 elements and given 30 seconds to respond. If the player answers correctly all points are received. If answered incorrectly, the fourth name and another 30 seconds is provided. Half the wager is received if the question is answered correctly. If no answer or an incorrect answer is given, the full wager is deducted from the player's score.

If Other Player Choice is landed on, then the other players select a trivia category by majority vote or other reasonable method such as rolling the dice, mutual agreement, etc.

The game continues from player to player until one player meets or exceeds forty (40) points. Upon obtaining 40 points, the player becomes the winner.

It is understood that the game is designed to be fast paced and entertaining via the short time frame for answering questions and the amusement provided to all players during the play. The presently described game is not limited to listing actors names who starred in movies. Indeed, the categories could be a wide variety of topics such as types of songs (country, rock, jazz) wherein the question would be names of songs by a particular artist, for example, "Rocky Mountain High", "Annie's Song", "Sunshine on my Shoulders", "Back Home Again", "Thank God I'm A Country Boy" would yield an answer of John Denver in a country music category. Another category could be countries, for example, Seine River, Eiffel Tower, Champagne, Riviera are all geographical places in France. Thus, the present game can be both a trivia game as well as a learning reinforcement game. The questions can be made to target different age groups, interest groups, religious groups, etc.

Although a preferred embodiment of the method and apparatus of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

What is claimed is:

1. In a question and answer game for entertaining a plurality of players, said game comprising:

a game board having a plurality of playing spaces organized in a path, said playing spaces randomly depicting a plurality of categories;

a plurality of game pieces for indicating which one of said plurality of playing spaces a player is on;

a random number generator for generating a random number between zero and a predetermined positive integer;

a timing device for timing a predetermined time interval of less than two minutes;

a plurality of category question means listing elements as an answer to a question; and a scorecard for keeping track of said player's score;

the method of said question and answer game comprising said steps of:

generating a random number;

moving one of said plurality of game pieces a number of said playing spaces equal to said random number;

reading a first portion of one of said plurality of category questions that correspond with said one of said plurality of categories depicted by said playing space which said one of said plurality of game pieces was moved to;

timing a first predetermined time interval;

attempting to provide a correct answer to said first portion of said one of said plurality of category questions within said first predetermined time interval;

awarding a first score if said correct answer is provided;

reading a second portion of said one of said plurality of category questions;

timing a second predetermined time interval;

attempting to provide said correct answer to a combination of said first portion and said second portion of said category questions within said second predetermined time interval; and awarding a second score if said correct answer is provided.

2. A method of playing a board game comprising a playing board having a path of playing spaces, a question having elements that are contained in an answer to said question, and a timing device, said method of playing comprising the steps of:

landing on one of said playing spaces;

being provided a first portion of said elements and a first predetermined amount of time to provide said answer; and being provided a second portion of said elements and a second predetermined amount of time to provide said answer.

3. The method of claim 2, further comprising the steps of:

receiving a first score if said answer is provided in said first predetermined amount of time; and receiving a second score if said answer is provided in said second predetermined amount of time.

4. The method of claim 2, wherein said question comprises the names of actors and actresses who starred in a motion picture and wherein the name of said motion picture is the answer.

5. The method of claim 2, wherein said question comprises the names of songs performed by an artist and wherein said artist is the answer.

6. The method of claim 2, wherein said question comprises geographical sites within a country and wherein said country is the answer.

7. The method of claim 2, wherein said playing space defines a category from which said question is related to.

* * * * *